US010682782B2

(12) United States Patent
Honegger et al.

(10) Patent No.: US 10,682,782 B2
(45) Date of Patent: Jun. 16, 2020

(54) APPARATUS AND METHOD FOR STRIPPING AWAY/PUSHING OUT A PUNCHED GRID/INTERNALLY FORMED PART AND EJECTING A BLANKED PART IN A PRECISION BLANKING PRESS

(71) Applicant: Feintool International Holding AG, Lyss (CH)

(72) Inventors: Hans-Ruedi Honegger, Wolfhausen (CH); Andreas Walther, Laupen (CH); Alex Wehrli, Kehrsatz (CH)

(73) Assignee: Feintool International Holding AG, Lyss (CH)

( * ) Notice: Subject to any disclaimer, the term of this patent is extended or adjusted under 35 U.S.C. 154(b) by 25 days.

(21) Appl. No.: 15/203,517

(22) Filed: Jul. 6, 2016

(65) Prior Publication Data

US 2017/0008186 A1 Jan. 12, 2017

(30) Foreign Application Priority Data

Jul. 6, 2015 (EP) ..... 15002020

(51) Int. Cl.

| | |
|---|---|
| ***B30B 15/16*** | (2006.01) |
| ***B30B 15/32*** | (2006.01) |
| ***B26D 7/18*** | (2006.01) |
| ***B21D 28/20*** | (2006.01) |
| ***B21D 28/16*** | (2006.01) |

(52) U.S. Cl.

CPC ..... *B26D 7/1818* (2013.01); *B21D 28/16* (2013.01); *B21D 28/20* (2013.01); *B30B 15/16* (2013.01); *B30B 15/32* (2013.01); *B26D 2007/189* (2013.01)

(58) Field of Classification Search

CPC .... B23D 5/12; B26D 2007/189; B20B 15/16; Y10T 83/8832

See application file for complete search history.

(56) References Cited

U.S. PATENT DOCUMENTS

| | | | | |
|---|---|---|---|---|
| 3,564,959 A * | 2/1971 | Suguru Harada | ..... | B21D 28/16 100/218 |
| 3,640,167 A * | 2/1972 | Axtmann | ..... | B21D 28/16 83/380 |
| 3,739,669 A * | 6/1973 | Seki | ..... | B21D 28/16 83/123 |
| 4,040,391 A * | 8/1977 | Zeilinger | ..... | F02B 53/10 123/207 |

(Continued)

FOREIGN PATENT DOCUMENTS

| | | |
|---|---|---|
| DE | 1145115 B | 3/1963 |
| DE | 1279622 B | 10/1968 |

(Continued)

*Primary Examiner* — Andrea L Wellington
*Assistant Examiner* — Fernando A Ayala
(74) *Attorney, Agent, or Firm* — Norris McLaughlin, P.A.

(57) ABSTRACT

In an apparatus and a method for stripping/pushing out a punched grid and for ejecting a blanked part from a die in a precision blanking press, the force of stripping/pushing out and ejection can be adjusted independent of the knife-edged ring force and the counterstay counteracting force while reducing the mass of the knife-edged ring and counterstay pistons, increasing the stripping/pushing and ejection speeds, and at the same time simplifying the hydraulic circuit.

9 Claims, 8 Drawing Sheets

(56) References Cited

U.S. PATENT DOCUMENTS

| | | | | | |
|---|---|---|---|---|---|
| 4,611,483 | A | | 9/1986 | Hadaway | |
| 4,872,381 | A | * | 10/1989 | Stroms | B21D 31/02 83/76.1 |
| 4,905,556 | A | * | 3/1990 | Haack | B21D 28/16 72/335 |
| 4,958,548 | A | | 9/1990 | Schulze | |
| 5,253,559 | A | * | 10/1993 | Philippe | H05K 3/005 83/133 |
| 5,692,423 | A | * | 12/1997 | Hachikawa | B26D 7/086 83/137 |
| 5,915,413 | A | * | 6/1999 | Helmsderfer | F16L 59/16 137/247.49 |
| 6,223,636 | B1 | * | 5/2001 | LaPlante | B26F 1/04 83/13 |
| 6,240,818 | B1 | | 6/2001 | Baltschun | |
| 2008/0092711 | A1 | * | 4/2008 | Thielges | B21D 22/08 83/552 |
| 2009/0044671 | A1 | * | 2/2009 | Greenleaf | B21D 28/26 83/133 |
| 2010/0133897 | A1 | * | 6/2010 | Von Hayn | B60T 7/042 303/155 |

FOREIGN PATENT DOCUMENTS

| | | | |
|---|---|---|---|
| DE | 1930398 | A1 | 12/1970 |
| DE | 2218476 | A1 | 9/1973 |
| DE | 2264429 | A1 | 9/1973 |
| DE | 2218475 | A1 | 10/1973 |
| DE | 3423543 | A1 | 1/1985 |
| DE | 19642635 | A1 | 10/1997 |
| DE | 102007017595 | A1 | 1/2009 |
| EP | 0891235 | B1 | 10/2003 |
| WO | 8903484 | A1 | 4/1989 |

* cited by examiner

PRIOR ART

PRIOR ART

APPARATUS AND METHOD FOR STRIPPING AWAY/PUSHING OUT A PUNCHED GRID/INTERNALLY FORMED PART AND EJECTING A BLANKED PART IN A PRECISION BLANKING PRESS

BACKGROUND OF THE INVENTION

The invention relates to an apparatus for stripping away a punched grid, pushing out an internally formed part and ejecting a blanked part in a precision blanking press, comprising a knife-edged ring cylinder disposed in the top, a knife-edged ring piston for generating a knife-edged ring force that acts on knife-edged ring pins being guided in said cylinder and optionally pressurized by hydraulic fluid by way of a pressure chamber, a main cylinder disposed in the base, a main piston/ram with a counterstay piston that acts on pressure pins to generate a counteracting force being guided in said main cylinder and optionally pressurized by hydraulic fluid through a pressure chamber, said main piston/ram making a stroke movement in the direction of the stroke axis and supporting a table top, and a hydraulic system for supplying the pressure chambers disposed in the top and base with the hydraulic fluid, the fluid being adjusted to a predetermined working pressure by way of a central control system.

The invention further relates to a method for stripping away a punched grid from the blanking punch, pushing out an internal shape and ejecting a blanked part from the die block of a die in a precision blanking press with an upwardly-moving main piston disposed in the base, wherein, firstly, a knife-edged ring force for pressing the knife-edged ring into the material to be blanked is generated using a knife-edged ring piston disposed in the top of the press, said force acting on a guide or knife-edged ring block by way of knife-edged ring pins, and a counteracting force directed opposite to the blanking is generated using a counterstay piston disposed in the base, whereupon the hydraulic fluid is displaced from the pressure chambers of the knife-edged ring or counterstay piston at an adjustable pressure during blanking, and after blanking the pressure chamber of the knife-edged ring piston in the top and the pressure chamber of the counterstay piston in the base are pressurized by a hydraulic fluid from a hydraulic system, the fluid being set to a predetermined working pressure, the pressure chambers being set, using a central control system, to a predetermined stripping/pushing force which strips the punched grid and pushes out the internally formed part, and to a predetermined ejection force which ejects the blanked part.

Precision blanking and the methodology thereof has been known for a long time. The characterizing methodological features include the design of the die, the knife-edged ring, the punch clearance and the acting forces. The precision blanking die comprises an upper part and a lower part. The upper part includes at least one guide or knife-edged ring block which is acted upon by a knife-edged ring force generated by a knife-edged ring piston of a precision blanking press by way of pressure pins, a blanking punch for blanking out a blanked part from the material to be blanked, the punch being guided in the guide or knife-edged ring block, and a pusher for pushing out an internally formed part from the punch. The bottom part contains a die block or matrix, and an ejector guided in the punch, the ejector being acted upon by a counterforce generated by a counterstay piston of the precision blanking press by way of pressure pins, the counterforce counteracting the punch. The material to be blanked is clamped between the guide or knife-edged ring block and the die block. At the beginning of the blanking process, the knife-edged ring located in the guide or knife-edged ring block is pressed into the material to be blanked through the force of the knife-edged ring. Upon subsequent blanking, this force is displaced by the upwardly-moving main piston, and strips away the punched grid from the punch after the blanking is finished, and pushes out the inner shape into the opened interior space of the die. At the beginning of blanking, the counterforce generated by the counterstay piston presses against the punch and is exceeded by the punching force. At the end of the blanking process, this force ejects the blanked part pressed into the die block into the interior of the die ("Umformen and Feinschneiden, Handbuch für Verfahren, Werkstoffe, Teilgestaltung" (Forming and Precision Blanking, Handbook on Methods, Materials, Part Design), pg. 141-153, Verlag Hallwag AG, 1997).

The precision blanking process requires three special triple-acting presses which operate upward from below and which provide controlled regulation of the blanking process, with ancillary functions for the knife-edged ring, the counterstay and the ejector. The forces of the knife-edged ring and counterstay are hydraulically generated and the punching force is mechanically or hydraulically generated.

There are a number of piston arrangements that can be used in presses to drive the process or to apply pressure.

DE 1 145 115 discloses a triple-acting hydraulic press with a working cylinder, an annular piston surrounding the same, a counterpiston and an intermediate chamber disposed between the working piston and the annular piston, the intermediate chamber being able to be blocked off using a pressure regulating valve.

DE 1 279 622 A1 describes a precision stamping press with a punch piston, a pressing piston for pressing the sheet workpiece against the press table and a counterpressure piston for supporting the part to be stamped out from the workpiece, wherein the punch piston is guided in the pressing piston in spring-activated fashion.

DE 1 930 398 A1 4471 discloses a press, in particular for precision stamping, comprising two ram systems to which half of a die is fastened, respectively. At least one ram system comprises two independently actuated piston systems, either of which can be individually selected at the press frame.

The prior art according to DE 2 218 476 A1 and DE 2 264 429 A1 relates to a precision stamping press comprising two frame members rigidly connected to one another to which two table members for clamping two die parts are attached, the table members being able to move toward and away from one another axially along a hydraulic path. In the first frame member, there is a cylinder chamber in which two coaxial piston are disposed moveably relative to one another, the first piston being connected to a piston rod and the second surrounding the piston rod and forming a part of the first table member, which is moveably attached to the first frame member. The second piston has an internal threading and is screwed onto a sleeve that has external threads such that the axial position of the second piston can be adjusted.

DE 34 23 543 A1 further discloses a metal-processing press consisting of a bottom part and a working punch arrangement that can be moved axially away from the bottom part in the direction of the bottom part. The working punch arrangement comprises a primary punch and a secondary punch disposed substantially coaxially, the punches being able to move axially relative to one another, wherein the primary punch can glide axially in an axial penetration of the secondary punch.

EP 891 235 B1 discloses a precision blanking press with a hydraulically- or mechanically-driven ram having at least one hydraulic knife-edged ring and counterstay cylinder each. The knife-edged ring cylinder and the counterstay cylinder are disposed in a support cylinder that is held in constant contact with pressure pins by way of connection elements, wherein the support cylinder pushes the knife-edged ring piston to the lower starting position thereof at the end of the working stroke when the working force is suspended such that the pressure pins push out the punched grid. The knife-edged ring cylinder is kept in a cylindrical housing in a cross-beam, a knife-edged ring piston being guided in said housing and held, by a piston of the cylinder under pressure by the pressure medium, in a position that is in constant contact with the pressure pins.

In all of these known solutions, the knife-edged ring piston acts as the stripping/pushing element and the counterstay piston acts as the element that initiates ejection of the blanked part, the elements performing the stripping/pushing and ejecting with the same acting surfaces as in the displacing of the knife-edged ring piston/counterstay piston. This means that the stripping/pushing and ejecting is done using a piston of high mass, which leads to high forces occurring at the end stop when the piston is applied, the forces leading to undesirable impacts. Also, very high amounts of oil are needed for the high ejection speeds that are required, especially by large pumps in direct drives.

DE 10 2007 017 595 B3 further discloses a precision blanking press with an upper belt supported by side stands from below and disposed above the ram, and wherein the approach stroke of the ram occurs upwardly from below. The knife-edged ring cylinder and the counterstay piston comprise an outer piston and an inner piston having active surfaces of different sizes that can be pressurized together or individually, such that three different knife-edged forces and counterstay forces are generated under the same system pressure, wherein the common acting surfaces of the outer piston and the inner piston correspond to the total knife-edged ring force/total counterstay force and the acting surfaces of the inner piston correspond to the stripping/ejecting force. The knife-edged ring cylinder and counterstay cylinder volume displaced during the working stroke is conveyed to a pressure accumulator.

These known solutions do indeed make it possible to vary the stripping and ejecting force relative to the total knife-edged ring force, but the volume displacement continues to depend on the knife-edged ring piston such that adjustment of the stripping/pushing force and ejection force to match actual force requirements is not possible independent of the knife-edged ring force and the counterstay force. Also, the force in the knife-edged ring cylinder and counterstay cylinder must always be the same magnitude or greater than the pushing/ejection force, which limits applicability. The hydraulic circuit is complicated and expensive due to the controls within the knife-edged ring piston.

In light of this prior art, the object of the invention is to provide an apparatus and a method for stripping/pushing out a punched grid or internally formed part and for ejecting a blanked part from a die in a precision blanking press, wherein the force of stripping/pushing and ejection can be adjusted independent of the knife-edged ring force and the counterstay force while reducing the mass of the knife-edged ring and counterstay pistons, increasing the stripping/pushing-out and ejection speeds, and at the same time simplifying the hydraulic circuit.

SUMMARY OF THE INVENTION

The solution according to the invention starts from the position of stripping the punched grid, pushing out the internally formed part and ejecting the blanked part separately and independent of the function of the knife-edged ring and counterstay piston.

This is achieved by providing that the knife-edged ring piston and a stripping/pushing piston form a separate constructive unit and that the counterstay piston and an ejecting piston form a separate constructive unit in the base, the units being separate from the knife-edged ring piston and counterstay piston, respectively, with pressure chambers that are independent of one another for the stripping/pushing piston on the one hand and for the ejecting piston on the other, wherein the pressure chambers of the stripping/pushing piston and the ejecting piston are in mutual connection by way of a first controllable hydraulic circuit of the hydraulic system, and wherein the pressure chambers of the knife-edged ring piston and the counterstay piston are in mutual connection by way of a second controllable hydraulic circuit.

Another preferred embodiment of the apparatus according to the invention provides that the stripping/pushing piston is disposed in a stripping/pushing cylinder that is separated from the knife-edged ring cylinder, the stripping/pushing cylinder being fastened positively and pressure-tight to the knife-edged ring cylinder at the top in the direction of the stroke axis, wherein a piston rod of the stripping/pushing piston penetrates through the middle of the knife-edged ring piston that is guided in the knife-edged ring cylinder and is fixed to a pusher block associated with the knife-edged ring piston at the bottom such that the stripping/pushing piston and the knife-edged ring piston can execute a stroke movement independently of one another.

This ensures that both pistons can move independently of one another and be hydraulically operated independently. The differentiation between a stripping piston and a knife-edged ring piston makes it possible to separate the surfaces needed for stripping/pushing from those needed for displacement, and to adjust the surfaces according to the actual force requirements.

It is beneficial that the knife-edged ring pins are disposed coaxial to the stroke axis in the knife-edged ring cylinder and that they are supported at a knife-edged ring piston block for moving the knife-edged ring, wherein the knife-edged piston block comprises a support member with through holes in which the pressure pins for stripping are disposed and move vertically.

According to another preferred embodiment of the apparatus, the stripping/pushing piston can be designed to be dual-acting with a first and second pressure chamber associated therewith in the stripping/pushing cylinder.

In another preferred embodiment of the apparatus according to the invention, the stripping/pushing cylinder is tightly sealed shut with a cover through which a hydraulic line connected to the hydraulic system is passed for pressurizing the first pressure chamber with hydraulic fluid of a predetermined pressure from the first hydraulic circuit.

Another advantage is that the wall section of the stripping/pushing cylinder is provided with a channel that runs parallel and perpendicular to the stroke axis for the purposes of pressurizing the second pressure chamber with hydraulic fluid of a predetermined pressure from the first hydraulic circuit of the hydraulic system.

This ensures that the cylinder chamber of the stripping/pushing cylinder and of the knife-edged ring cylinder chamber are each able to be pressurized with fluid of a correspondingly adapted pressure separately from one another. All of these features also ensure that the stripping-pushing cylinder form a compact unit together with the knife-edged ring cylinder and counterstay cylinder, and can be easily and simply connected to the hydraulic system.

According to another preferred embodiment of the invention, what is further provided is that a counterstay cylinder chamber is formed in the main piston for the counterstay piston, an ejector piston being disposed in said chamber and being displaceable axially in the stroke direction, the piston rod of said ejector piston penetrating through the middle of the counterstay piston and leading to the separate pressure chamber, said chamber connected to the first hydraulic circuit of the hydraulic system by way of a channel in the main piston running perpendicular to the stroke axis for purposes of pressurization with hydraulic fluid of a predetermined pressure, wherein the ejector piston and the counterstay piston can make a stroke movement independent of one another.

In another embodiment of the invention, the main piston is provided with a channel that runs parallel and perpendicular to the stroke axis for the purposes of pressurizing the pressure chamber of the counterstay piston with hydraulic fluid of a predetermined pressure from the second hydraulic circuit of the hydraulic system.

According to another preferred embodiment of the invention, channels for feeding hydraulic fluid of a predetermined pressure from the hydraulic system are made in the base so that each pressure chamber can be pressurized separately corresponding to the required pressures, whereby it is ensured that the ejector piston and the counterstay piston can be controlled independently of one another.

In another useful embodiment of the invention, the first hydraulic circuit comprises a high-pressure accumulator for the pressure chambers, the accumulator being adjusted to the working pressure of the stripping/pushing piston and ejector piston by the hydraulic system by way of a built-in valve, at least one 4/3-way proportional valve associated with each pressure chamber of the stripping/pushing piston and ejector piston for the purposes of turning on and shutting off the pressure chambers, wherein a pressure sensor is provided for the proportional valve, and a pressure sensor is provided for the proportional valve for controlling the built-in valve.

What is very important for independently controlling the two hydraulic circuits is that the second hydraulic circuit comprises at least one built-in valve that connects the two pressure chambers of the knife-edged ring piston and the counterstay piston and that adjusts the working pressure, at least one pressure sensor for controlling the built-in valve and at least one hydraulic pump unit with at least one associated built-in valve for adjusting the flow, at least one pressure sensor for controlling the built-in valve and at least one pressure limiting valve for limiting the pressure and for maintaining the flow stream. The second hydraulic circuit thus operates autonomously and independently of the first hydraulic circuit, the built-in valves of which can be controlled by way of the pressure sensors of the central control system.

The object is further achieved by a method wherein the stripping/pushing force and the knife-edged ring force as well as the ejector force and the counterstay force are generated in pressure chambers that are separate from one another, using active surfaces that are correspondingly matched to the stripping/pushing and ejecting processes, wherein the pressure chambers for the stripping/pushing force and the pressure chambers for the knife-edged ring and counterstay force are controlled by the central control system using hydraulic fluid of a preset pressure in separate hydraulic circuits of the hydraulic system in such a way that the knife-edged ring piston and the counterstay piston lag behind the stripping/pushing piston and ejector piston during stripping and ejecting.

What is particularly advantageous is that the acting surfaces in the pressure chambers for stripping/pushing out and ejecting can be selected to be of different sizes or of the same size so that the magnitude of the stripping/pushing force and the ejection force can be adjusted independently of the magnitudes of the knife-edged ring and counterstay forces.

Other advantages and details can be found in the following description, with reference to the attached drawings.

The invention is explained in closer detail below with the help of an exemplary embodiment.

DETAILED DESCRIPTION OF THE INVENTION

Figure 1:
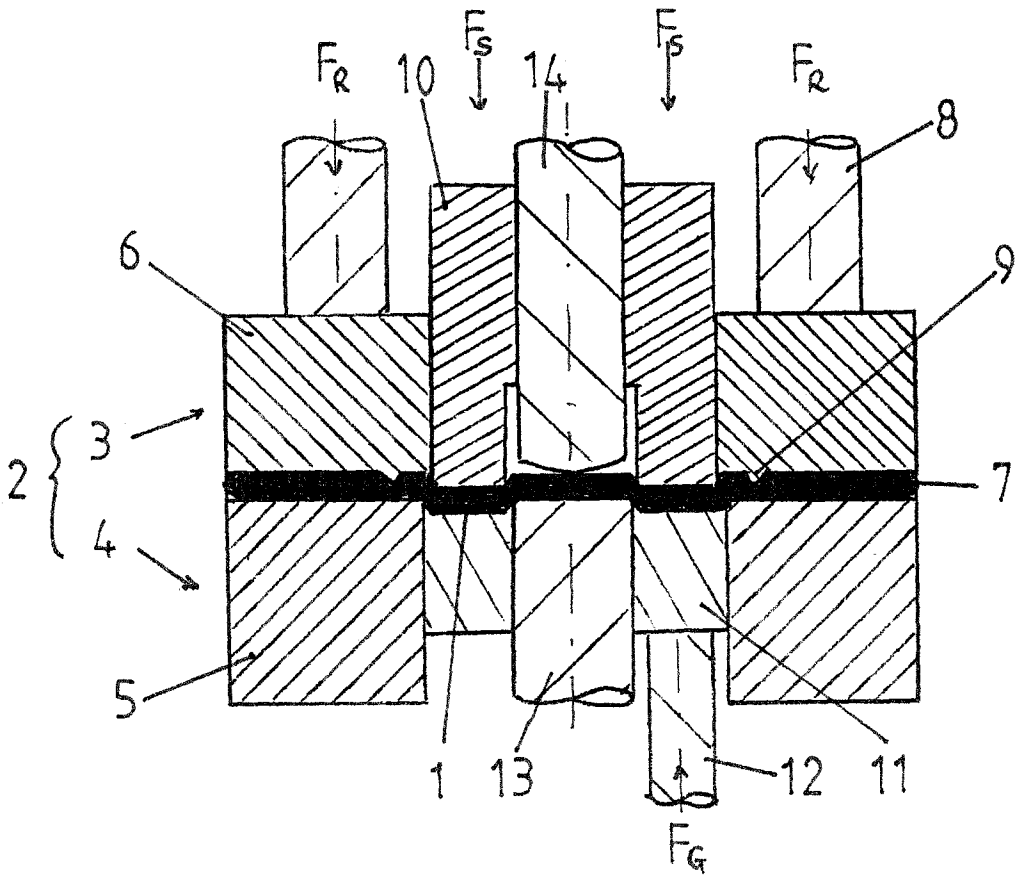
FIG. 1 a schematic representation of the precision blanking process according to the prior art, FIG. 2 a schematic representation of the stripping/pushing and ejection process in precision blanking according to the prior art, FIG. 3 a section of the top with knife-edged ring cylinder and stripping/pushing cylinder, FIG. 3 a section of the top of the press, FIG. 4 a section of the stripping/pushing cylinder with knife-edged ring cylinder, FIG. 5 a section of the stripping/pushing cylinder with a representation of the channel for the pressure chamber of the knife-edged ring cylinder, FIG. 6 a section of the base of the press with table top, FIG. 7 a section of the main piston with table top and FIG. 8 a schematic representation of the operational sequence of the method according to the invention.

FIG. 1 shows the working principle of precision blanking in the manufacture of a blanked part 1 with an inner shape in a punch die 2 made up of a top part 3 and a bottom part 4. The material to be blanked 7 is clamped between the die block 5 of the bottom part 4 and the guide or knife-edge ring block 6 of the top part 3. The knife-edged ring force $F_R$ acting on the guide or knife-edged ring block 6 by way of pressure pins 8 has pressed the knife-edged ring 9, which is located in the guide or knife-edged ring block 6, into the material to be blanked 7. In the positional state shown, the punch 10, which is guided by the guide or knife-edged ring block 6, cuts into the material to be blanked 7 with punching force $F_S$, wherein a counterstay 11 counteracts the punch 10 with counterforce $F_G$ applied to the counterstay 11 by way of pressure pin 12. The hole punch 13 is guided in the counterstay 11 and punches the inner shape into the material to be blanked 7 counter to the punching force $F_S$ of the punch 10.

The pusher 14 acts as a counterstay for the hole punch 13.

Figure 2:
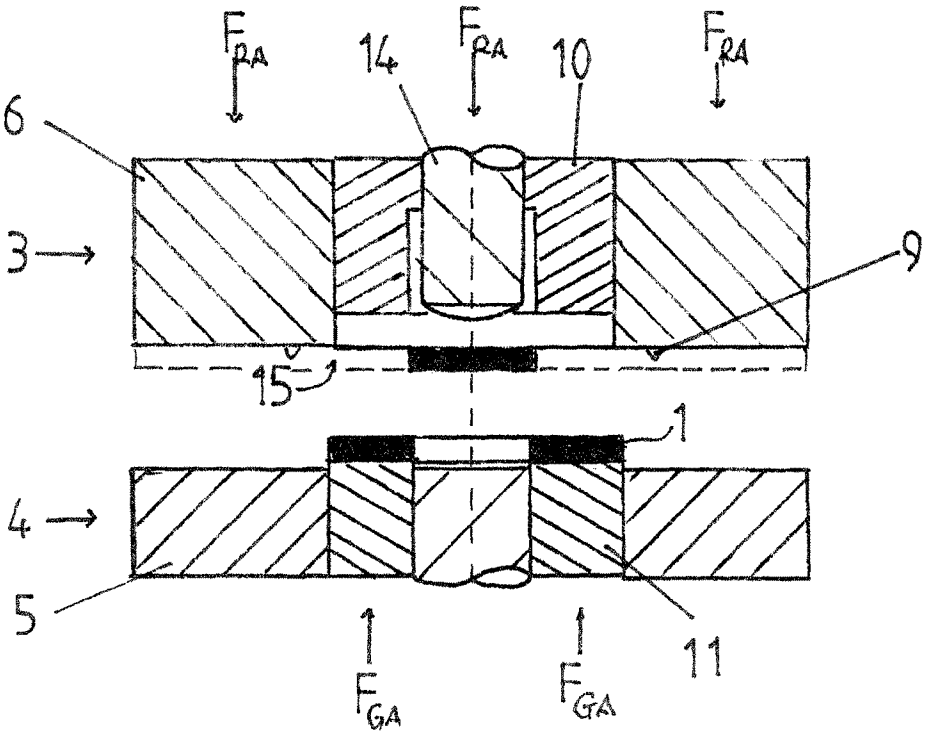

Shown schematically in FIG. 2 is the stripping/pushing process for the punched grid 15 and the part to be blanked 1. Prior to the beginning of blanking, the knife-edged ring 9 is pressed into the material to be blanked 7 outside of the cut line. During blanking using the punch 10, the force $F_R$ is displaced by the upwardly-moving main piston/ram of the precision blanking press and the punched grid 15 is stripped away from the punch 10 by the stripping force $F_{RA}$ after blanking is finished and while the die is open, and the inner shape is pushed out into the die cavity.

At the beginning of blanking, the counterforce $F_G$ immediately acts against the die 10 and is exceeded by the punching force $F_S$. When the blanking process has ended, the ejection force $F_{GA}$ ejects the blanked part 1 from the punch opening of the die block 5.

The pressure pins 8 for the guide or knife-edged ring block 6 and the pressure pins 12 for counterstay 11 are hydraulically actuated.

Figure 3:
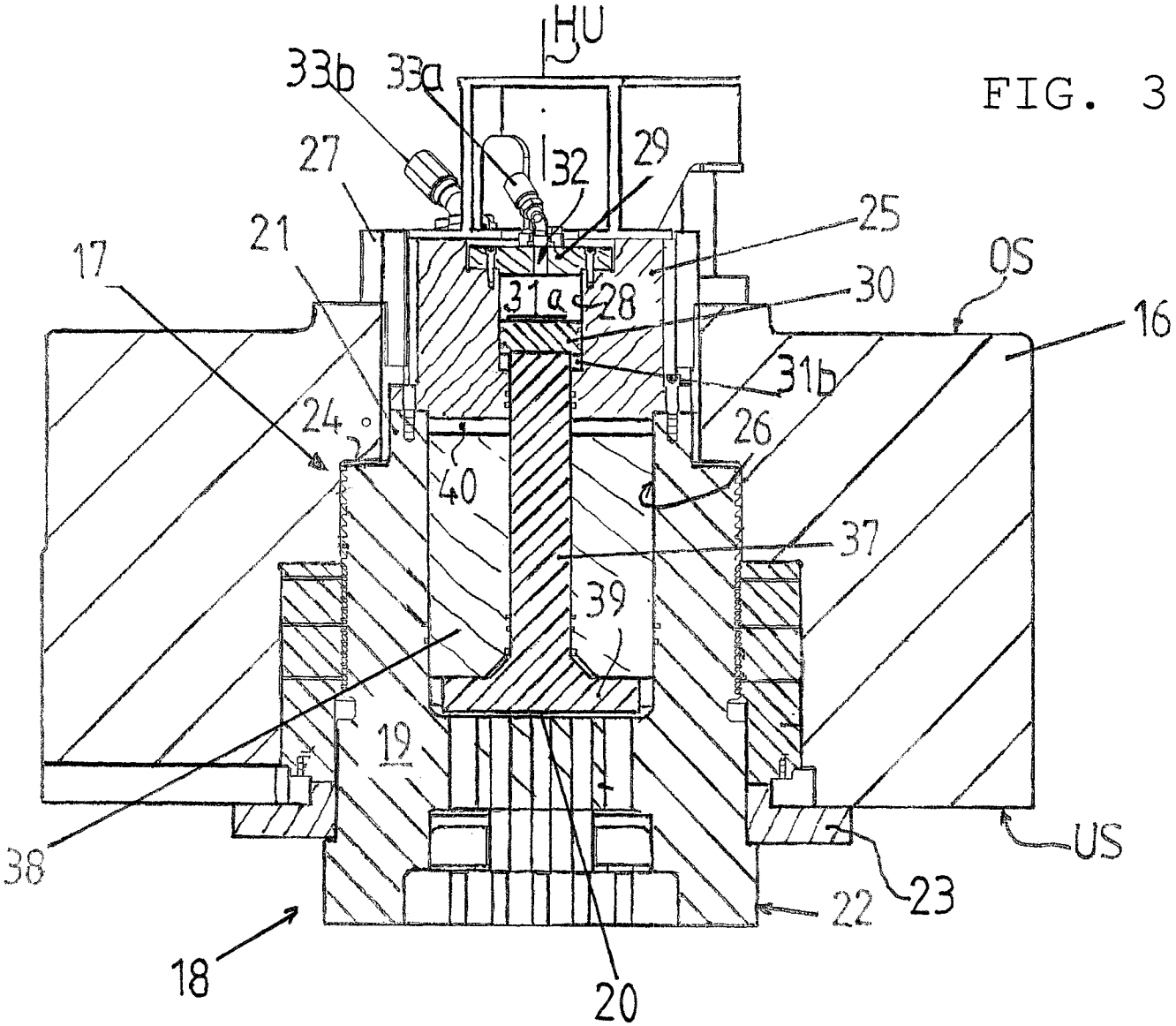

FIG. 3 shows the top 16 of a hydraulic precision blanking press, which is not further illustrated. A receiving space 17 for a knife-edged ring cylinder 19 designed as a core member 18 is disposed in the top 16 of the press in line with the stroke axis HU, the ring cylinder having a perforated base 20 facing the bottom side US of the top 16, a tubular neck 21 facing the top side OS of the top 16 and a flange 22 associated with the perforated base 20.

Figure 4:
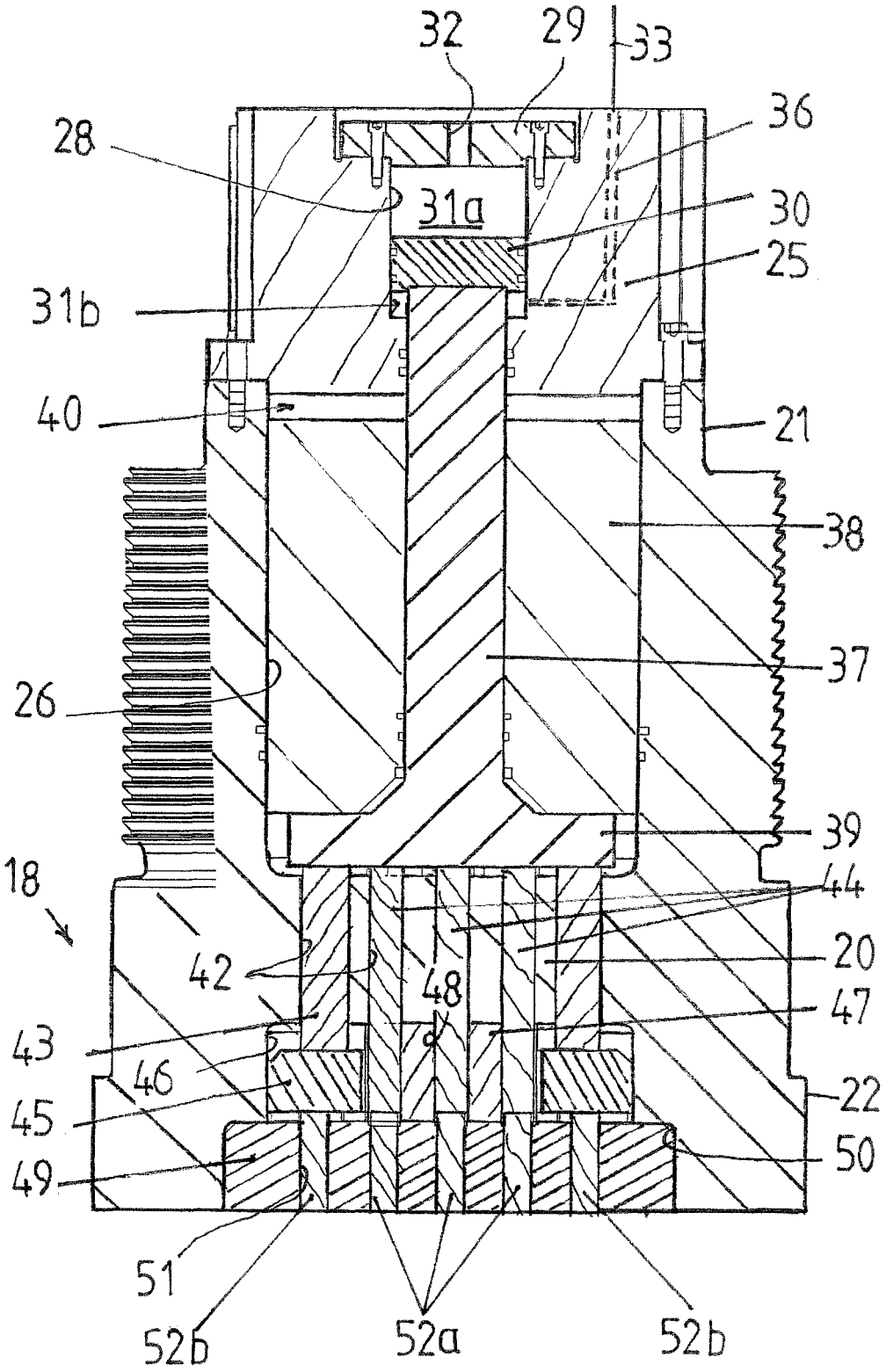

A stripping/pushing cylinder 25 is placed on the tubular neck 21 at the end of the core member 18 in abutment therewith—as shown in FIG. 4—coaxial to the stroke axis HU, the cylinder sealing the knife-edged ring cylinder chamber 26 pressure-tight by way of bolted attachment. The stripping/pushing cylinder 26 and the core member 18 are secured at the top 16 against rotation using a groove piece 27. A cylinder chamber 28 is formed in the stripping/pushing cylinder 25, the chamber being closed in by way of a cover 29 that is bolted on pressure-tight and holds a dual-acting stripping/pushing piston 30.

The stripping/pushing piston 30 subdivides the cylinder chamber 28 into a first pressure chamber 31*a* associated with one side of the stripping/pushing piston 30 and a second pressure chamber 31*b* associated with the other side of the stripping/pushing piston 30. The cover 29 has a center feed opening 32 for connecting a hydraulic line 33 of the hydraulic system 34 in order to pressurize the first pressure chamber 31*a* with hydraulic fluid.

The second pressure chamber 31*b* is connected to the hydraulic system 34 for purposes of pressurization with hydraulic fluid of a predetermined pressure, said connection being made by way of a channel 36 made in the wall area 35 of the stripping/pushing cylinder 25 parallel and perpendicular to the stroke axis HU and through hydraulic line 33*a* (see FIG. 4).

The stripping/pushing piston 30 is connected to a piston rod 37 that is passed through a knife-edged ring piston 38 that is guided in the knife-edged ring cylinder chamber 26 along the stroke axis HU, the piston rod supporting a pusher block 39 supported on the perforated base 20 of the core member 18.

Figure 5:
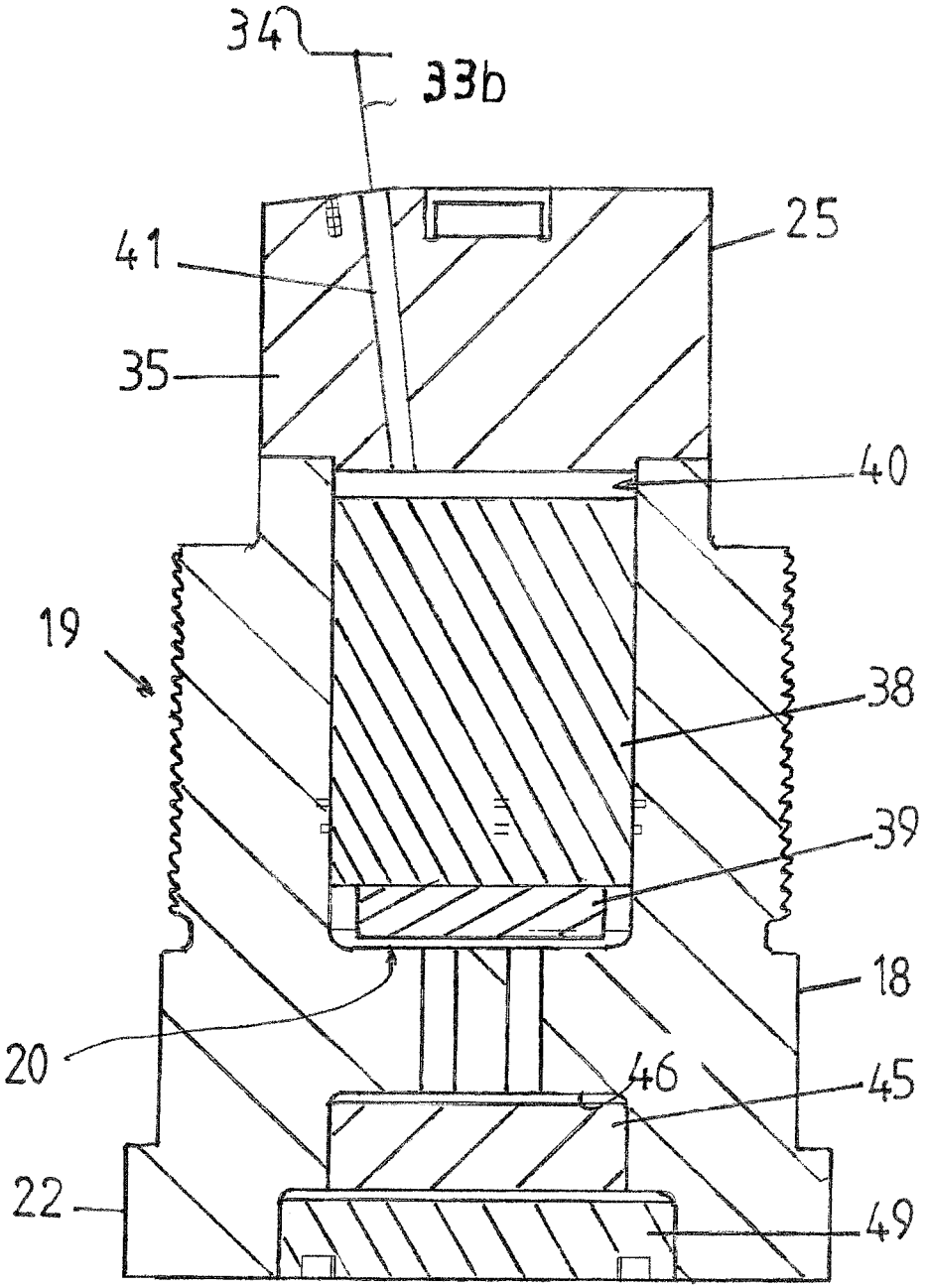

A pressure chamber 40 is associated with the knife-edged ring piston 38 in the knife-edged ring cylinder chamber 26, the pressure chamber being connected through hydraulic line 33*b* to the hydraulic system 34 by way of another channel 41 disposed in the wall area 35 of the stripping/pushing cylinder 25 (see FIG. 5).

Knife-edged ring pins 43 and pressure pins 44 associated with the knife-edged ring piston 38 are guided vertically displaceably in the holes 42 of the perforated base 20 in line with the stroke axis HU. Immediately below the perforated base 20 lies a coplanar piston block 45 inside a recess 46 of the core member 18, the piston block enclosing a centrally disposed, cylindrical washer-shaped support member 47. The support member 47 has through holes 48 for the pressure pins 44, the holes disposed coaxial to the stroke axis HU. A support block 49 is located below the piston block 45 in another recess 50 that is opposite recess 46 and that is displaced outward in stepped fashion, wherein the support block 49 is disposed coplanar to the piston block 45.

Through holes 51 are located in the support block 49, pressure pins 52*a* and 52*b* being guided in said holes, wherein pressure pins 52*a* are associated with pressure pins 44 penetrating the support member 47 and pressure pins 52*b* are associated with the knife-edged ring pins 43.

In the blanking process, pressure pins 52*a* and 52*b*, piston block 45, pressure pins 44, knife-edged ring pins 4L pushing block 39, piston rod 37, stripping/pushing piston 30 and knife-edged ring piston 38 move synchronously upward, in other words toward top 4. The hydraulic fluid in the pressure chamber 40 of knife-edged ring piston 38 and in pressure chamber 31*a* of the stripping/pushing piston 30 is displaced.

As soon as the main piston/ram 55 reaches the upper dead point OT, the stripping/pushing piston 30 is activated and the stripping process begins, in other words working chamber 31 a is pressurized with hydraulic fluid. Stripping/pushing piston 30 synchronously pushes the pusher block 39 and thereby all pressure pins 52*a*, 52*b*, knife-edged ring pins 43 and pressure pins 44 as well as the piston block 45 downward, in other words toward base 53. Said pressure pins push on the pressure pins in the die, which are not further shown, which strip away the punched grid from the punch and push out the internally formed part.

The knife-edged ring piston 38 follows behind the stripping/pushing piston 30 in parallel therewith or with a time delay, and at a lower speed, when working chamber 40 is pressurized with hydraulic fluid.

Figure 6:
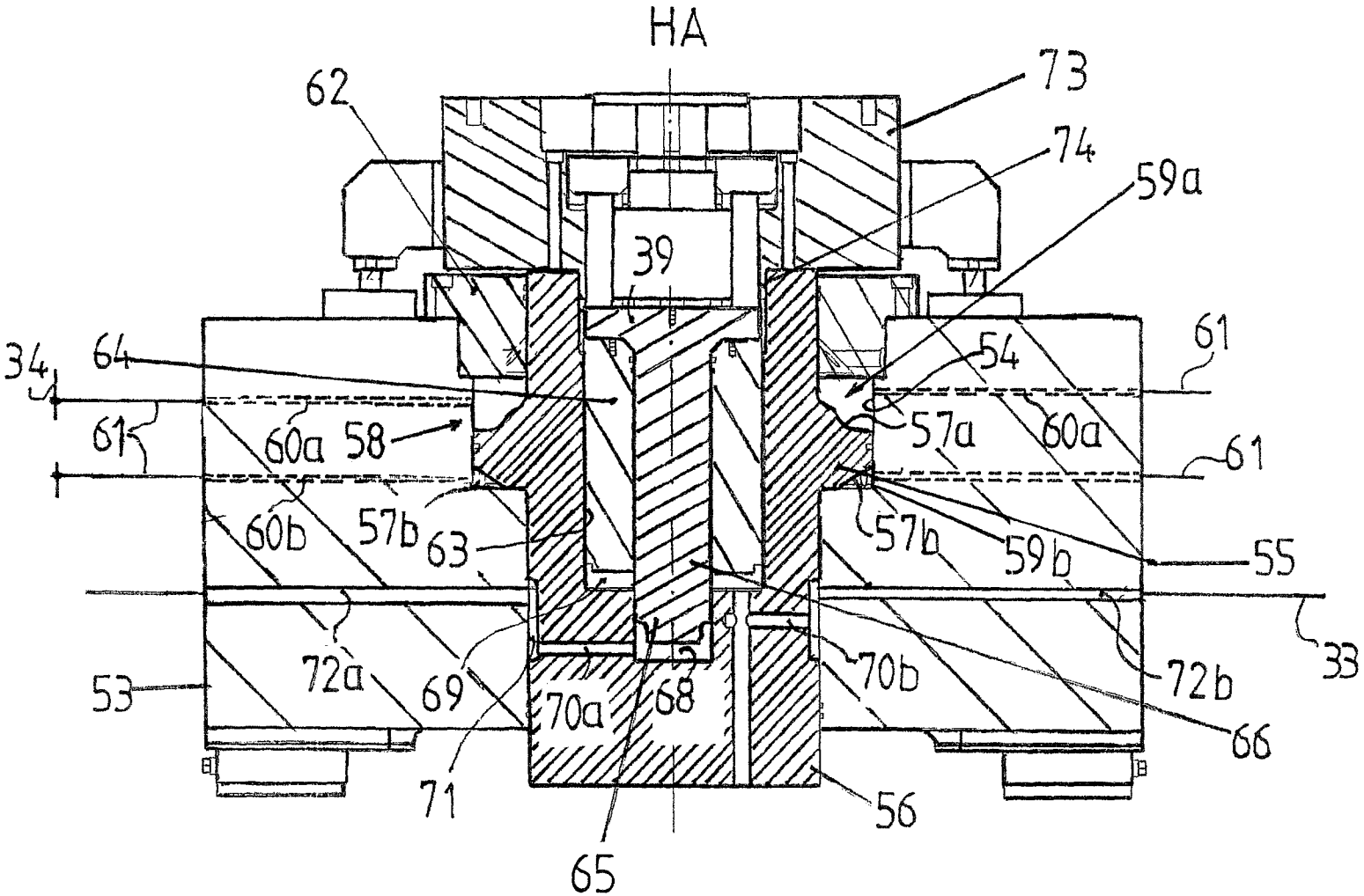

FIG. 6 shows the base 53 in a sectional representation. A main cylinder chamber 54 is formed in the base 53, the axis HA of the chamber lying on the stroke axis HU of the precision blanking press and holding the dual-acting main piston 55. The main piston 55 has a cylindrical shaft 56 comprising protruding discus-shaped working surfaces 57*a* and 57*b* that protrude out perpendicularly from the axis HA of the shaft, the surfaces subdividing the main cylinder chamber 58 into two pressure chambers 59*a* and 59*b* with minimal travel so that base 53 has a low design height. Pressure chambers 59*a* and 59*b* are each connected to the hydraulic system 34 through a channel 60*a* and 60*b*, respectively, and corresponding connections and hydraulic lines 61. The main cylinder chamber 58, and as a result pressure chamber 59*a*, is sealed off pressure-tight by way of a cover 62.

Depending on the pressurization of pressure chambers 59*a* and 59*b* with hydraulic fluid of a predetermined pressure, the main piston makes a corresponding stroke movement between the upper dead point OT and the lower dead point UT.

A counterstay cylinder chamber 63 is formed in the main piston 55, a counterstay piston 64 and an ejector piston 65 being held in said chamber, the piston rod 66 of the ejector piston passing through the middle of the counterstay piston 64 and ending in a pressure chamber 68 for piston rod 66 with pusher block 39. The counterstay piston 64 separates out a pressure chamber 69 in the cylinder chamber 63 of the main piston 55.

Pressure chamber 68 for the ejector piston 65 and pressure chamber 69 for the counterstay piston 64 are connected to hydraulic line 33 of the hydraulic system 34 by way of separate channels 70*a* and 70*b* made in the shaft 56 perpendicular to axis HA through distribution recesses 71 made in shaft 56 and channels 72*a* and 72*b* in the base 53.

Figure 7:
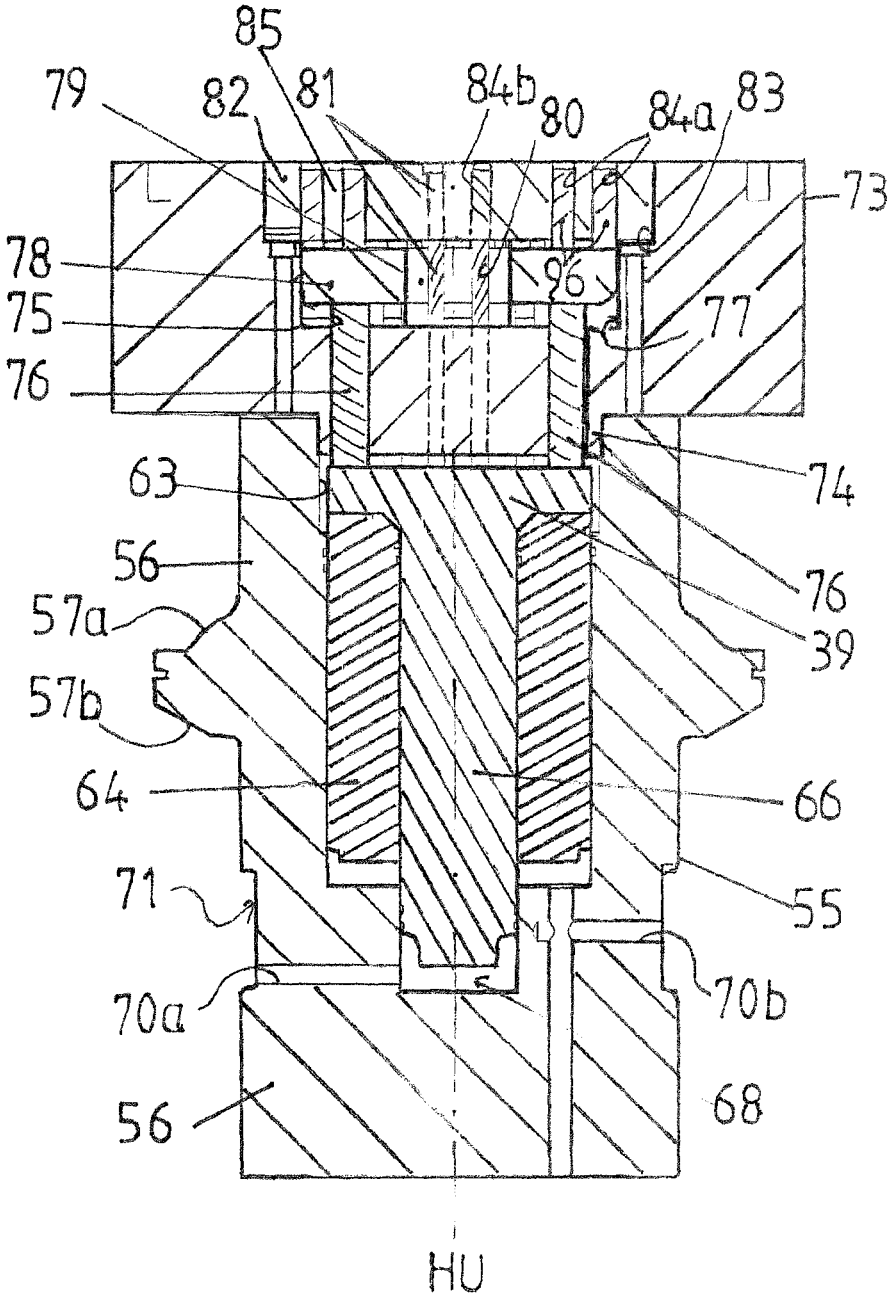

FIG. 7 refers to the arrangement and fastening of the table top 73 at main piston 55. The bottom of table top 73 abuts shaft 56 of the main piston 55 and has a protruding cylindrical bottom area 74 whose diameter is matched to the diameter of the shaft 56 of the main piston 55.

The bottom area 74 of the table top 73 is provided with holes 75 that run coaxial to the stoke axis HU. Counterstay pins 76 are guided in holes 75, the pins being supported by a piston block 78 disposed in a recess 77 above the bottom area 74, the block comprising a central cylindrical washer-shaped support member 79.

The support member 79 has through holes 80 coaxial to the stroke axis HU for pressure pins 81 that are led through the holes 80 of the support member 79. A support block 82 is located above piston block 78 in a recess 83 that is opposite recess 77 and that is displaced outward in stepped fashion, wherein the support block 82 is disposed coplanar to piston block 78.

Through holes 84*a* and 84*b* are made in the support block 82, wherein pressure pins 85 are guided in through holes 84*a*, the pins being associated with the counterstay pins 76 and the pressure pins 81 that pass through the through holes 84*b* through the support member 79.

Pressure pins 81 and 85, piston block 78, counterstay pins 76, ejector block 39, piston rod 66, ejector piston 65 and counterstay piston 64 move synchronously downward during the blanking step. The hydraulic fluid in the pressure chamber 68 of the ejector piston 65 and in pressure chamber 69 of the counterstay piston 64 is displaced.

As soon as the main piston 55 has reached the push-out switching point in upward movement when the die is opened, the ejector piston 65 is activated and the ejection of the blanked part punched into the die block begins, in other words pressure chamber 68 is pressurized with hydraulic fluid. Ejector block 39 presses all pressure pins 76, 81 and 85 as well as the piston block 78 synchronously upward. Pressure pins 81 and 85 press onto the pressure pins in the die, which are not further shown, which eject the blanked part out of the punch opening of the die block and into the internal cavity of the die.

The counterstay piston 64 follows behind in parallel therewith or with a time delay, and at a lower speed, when pressure chamber 69 is pressurized with hydraulic fluid.

Figure 8:
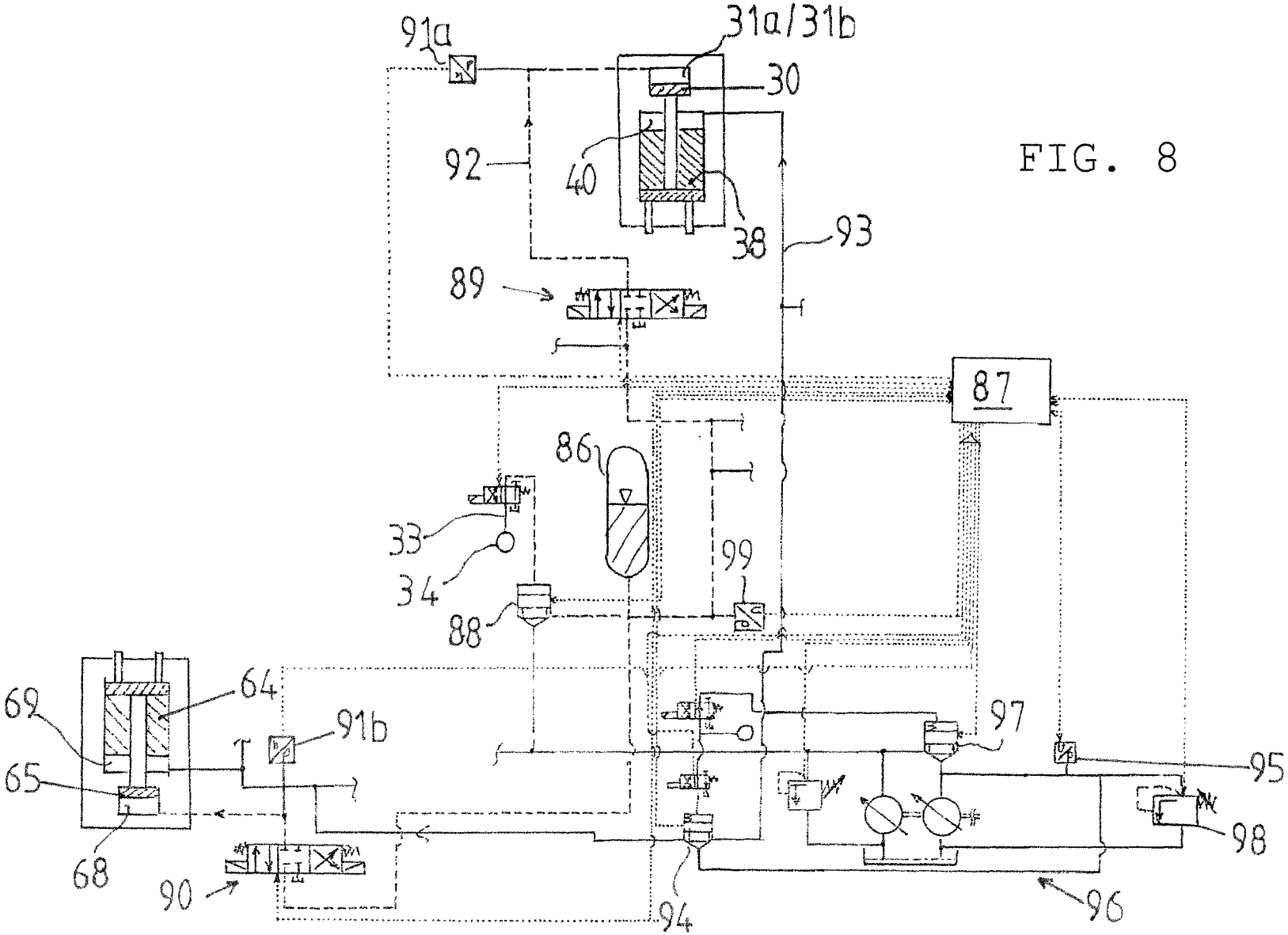

The operational sequence of the method according to the invention is described with the help of FIG. 8 which shows excerpts of the circuit of pressure chambers 31*a* and 31*b* of the stripping/pushing piston 30 including the pressure chamber 68 of the ejector piston 65 and of the circuit of pressure chamber 40 of the knife-edged ring piston 38 including pressure chamber 69 of the counterstay piston 64 in the first hydraulic circuit 92 and the second hydraulic circuit 93.

The pressure chambers 31*a* and 31*b* of the stripper/pusher piston 30 and the pressure chamber 68 of the ejector piston 65 in the first hydraulic circuit 92 are supplied by way of a common high-pressure accumulator 86 for hydraulic fluid, the accumulator being adjusted using a logical built-in valve 88 that is controlled by a central control system 87 and is connected to the hydraulic system 34 through hydraulic line 33 and adjusted to a desired pressure level matched to the stripping/pushing force $F_{RA}$ and ejector force $F_{GA}$. The adjustment and the turning on and off of the pressure chambers 31*a* and 31*b* as well as pressure chamber 68 is done using a respective 4/3-way proportional valve 89 and 90, said valve being integrated into the respective hydraulic line 33, wherein a respective pressure sensor 91*a* and 91*b* in hydraulic line 33 is associated with each valve for purposes of controlling the 4/3-way proportional valves 89 and 90 using the central control system 87.

The second hydraulic circuit 93 comprises at least one built-in valve 94 associated with the pressure chamber 40 of the knife-edged ring piston 38 and the pressure chamber 69 of the counterstay piston 64, said built-in valve adjusting the working pressure, at least one pressure sensor 95 for pressure detection in the second hydraulic circuit 93 and for sending the pressure value to the central control system 87 for controlling the built-in valve 94, and at least one hydraulic pump unit 96. Associated with the hydraulic pump unit 96 is at least one built-in valve 97 for adjusting the flow, at least one pressure limiting valve 98 for limiting the pressure of the flow stream and at least one pressure sensor 95 for pressure detection and sending the pressure value to the central control system 87 to control the built-in valve 94.

Pressure chambers 31*a*, 31*b* and 68 of the first hydraulic circuit 92 and pressure chambers 40 and 69 of the second hydraulic circuit therefore represent separate control circuits which are adjusted separately based on the position of the ram by the central control system by way of the built-in valve 88 and the 4/3-way proportional valves 89 and 90 on the one hand and the built-in valve 94 and the hydraulic pump unit 96 on the other.

The method according to the invention therefore makes it possible to control the stripper/pusher force $F_{RA}$ and the ejector force $F_{GA}$ independent of the knife-edged ring piston 38 and the counterstay piston 64.

In another variation, the hydraulic circuit 92 can also supply the pressure chamber 90 from the accumulator 86 and the hydraulic circuit 93 can supply the pressure chamber 31*a* from the pump.

The invention claimed is:

1. A hydraulically actuated apparatus configured to cooperate, as part of a fine blanking press, with a punch die comprised of a punch, a hole punch, a die block and a knife-edged ring block comprising a knife-edged ring, the punch having an axial throughhole and an annular distal end, the hole punch being configured to be received in the throughhole at the distal end of the punch, the punch die being configured to blank the workpiece to form a blanked part from an internal part of the workpiece and a part in the form of a grid, the hydraulically actuated apparatus comprising a top and a base, a knife-edged ring-actuating cylinder disposed in the top, a knife-edged ring-actuating piston received in the cylinder disposed in the top and configured to apply a force that acts on first pins, the first pins being guided in said cylinder and configured to act on the knife-edged ring block, said knife-edged ring-actuating cylinder including a pressure chamber configured to be pressurized by a hydraulic fluid, a main cylinder disposed in the base, a main piston with a counterstay piston actuated by a pressure chamber communicating only with the counterstay piston, the counterstay piston being configured to act on second pins, the second pins being guided in said base and configured to apply a force to the clamped workpiece counter to a punching force applied to the clamped workpiece by the punch, the main cylinder comprising pressure chambers configured to be pressurized by a hydraulic fluid to actuate the main piston, said main piston being configured to make a stroke in a direction of a stroke axis and thereby to blank the workpiece to form a grid retained on the die block and an interior part of the workpiece punched out by the hole punch and retained in the punch, and a hydraulic system for supplying the pressure chambers with the hydraulic fluid, a central control system configured to adjust the fluid to a predetermined working pressure, wherein the knife-edged ring-actuating piston and cylinder and a stripping/pushing piston and cylinder are disposed in the top as a first unit and the counterstay piston and an ejecting piston are disposed as a second unit in the base, the stripping/pushing piston is configured to apply a force to strip the grid from the die block and the ejection piston is configured to apply a force to eject the punched out part of the workpiece out of the punch, the stripping/pushing piston comprises a piston rod extending through and coaxially with the knife-edged ring-actuating piston, a pusher block is formed at a distal end of the piston rod abutting a surface of a distal end of the knife-edged ring-actuating piston, the pressure chamber in the knife-edged ring-actuating cylinder operatively communicates only with the knife-edged ring-actuating piston, the stripping/pushing cylinder is situated atop the knife-edged ring-actuating cylinder, at least one respective pressure chamber situated in the stripping/pushing cylinder operatively communicates only with the stripping/pushing piston and a respective pressure chamber operatively communicates only with the ejecting piston, the pressure chamber operatively communicating with the stripping/pushing piston and the pressure chamber respectively communicating with the ejecting piston are in mutual connection by way of a first controllable hydraulic circuit of a hydraulic system, and the respective pressure chambers operatively communicating with the knife-edged ring-actuating piston and with the counterstay piston respectively are in mutual connection by way of a second controllable hydraulic circuit wherein the first and the second controllable hydraulic circuits are configured to be controlled independently of one another and wherein the main piston is provided with a channel having a first section perpendicular to and a second section parallel to the stroke axis for pressurizing the pressure chamber which communicates operatively with the counterstay piston with hydraulic fluid of redetermined pressure from the second hydraulic circuit of the hydraulic system.

2. The apparatus according to claim 1, wherein the stripping/pushing piston is dual-acting and operatively communicates with first and second respective pressure chambers therefor in the stripping/pushing cylinder.

3. The apparatus according to claim 1, wherein the stripping/pushing cylinder is sealed pressure-tight by a cover through which a hydraulic line connected to the hydraulic system is guided for pressurizing the first pressure chamber with hydraulic fluid of a predetermined pressure from the first hydraulic circuit.

4. The apparatus according to claim 1, wherein the stripping/pushing cylinder comprises a channel in a wall area thereof for pressurizing the second pressure chamber with hydraulic fluid of a predetermined pressure from the first hydraulic circuit of the hydraulic system, the channel comprising a first section parallel to the stroke axis and a second section perpendicular to the stroke axis.

5. The apparatus according to claim 1, wherein the stripping/pushing cylinder is provided with a channel for pressurizing the pressure chamber operatively connected to the knife-edged ring-actuating piston with hydraulic fluid of a predetermined pressure from the second hydraulic circuit of the hydraulic system.

6. The apparatus according to claim 1, further comprising a channel in the main piston extending perpendicular to the stroke axis, which channel communicates between the first hydraulic system and the pressure chamber which communicates with the ejecting piston for purposes of pressurization with hydraulic fluid of a predetermined pressure, whereby the ejecting piston and the counterstay piston can make a stroke movement independent of one another.

7. The apparatus according to claim 1, wherein the first hydraulic circuit comprises a high-pressure accumulator, the accumulator being configured to operate at the working pressure of the stripping/pushing piston and ejecting piston by the hydraulic system by way of a built-in valve, a first proportional valve associated with the pressure chambers operatively communicating with the stripping/pushing piston and a second proportional valve associated with the pressure chamber operatively communicating with the ejecting piston for the purposes of turning on and shutting off the pressure chambers of the stripping/pushing piston and the ejecting piston, a pressure sensor for the first proportional valve, and a pressure sensor the second for proportional valve configured to control the built-in valve.

8. The apparatus according to claim 1, wherein the second hydraulic circuit comprises at least one first built-in valve configured to connect two of the respective pressure chambers of the ring piston and the counterstay pistons and for adjusting working pressure, at least one pressure sensor for controlling the built-in valve and at least one hydraulic pump unit associated with at least one second built-in valve for adjusting flow of hydraulic fluid, at least one pressure sensor for controlling the at least one second built-in valve and at least one pressure limiting valve for limiting pressure of the hydraulic fluid and maintaining flow thereof.

9. A method of using the apparatus of claim 1 to punch out the interior part of the workpiece thereby to form the punched out part and the grid from the workpiece, strip away the punched grid from the die block, and eject the punched out part from the punch, comprising first generating a force to press the knife-edged ring into the workpiece by use of the knife-edged ring-actuating piston and the stripping/pushing piston disposed in the top of the press, said force acting on the knife-edged ring block by way of the first pins, and generating a counteracting force directed opposite to the blanking by use of the counterstay piston disposed in the base of the press, whereupon the hydraulic fluid is displaced from the pressure chamber of the knife-edged ring-actuating piston or counterstay piston at an adjustable pressure during blanking and, after blanking, pressuring the pressure chamber of the knife-edged ring-actuating piston in the press top and pressuring the pressure chamber of the counterstay piston in the press base by the hydraulic fluid from the hydraulic system, the hydraulic fluid in the hydraulic system being set to a predetermined working pressure, then using the central control system, providing a predetermined stripping/pushing force for only to the stripping/pushing piston which strips the punched grid resulting from blanking of the workpiece and then setting the pressure chamber which communicates with the ejecting piston to a predetermined ejection force which ejects the punched out part, wherein the stripping/pushing force and the force applied to the knife-edged ring as well as the ejection force and the counteracting force are generated in pressure chambers that are separate from one another, using active surfaces that are correspondingly matched to the stripping/pushing and ejecting processes, wherein the pressure chambers for the stripping/pushing force and the pressure chambers for the force applied to the knife-edged ring and counteracting forces are controlled by the central control system using the hydraulic fluid of a preset pressure in the independently controlled first and second hydraulic circuits of the hydraulic system controlled so that the knife-edged ring-actuating piston which applies the force to the knife-edged ring and the counterstay piston which applies the counteracting force lag behind the stripping/pushing piston and ejector piston during stripping and ejecting.

* * * * *